US012571157B2

(12) United States Patent
Li et al.

(10) Patent No.: US 12,571,157 B2
(45) **Date of Patent: *Mar. 10, 2026**

(54) FLUOROCARBON CHAIN-FREE HYDROPHOBIC FABRIC, PREPARATION AND APPLICATION THEREOF

(71) Applicant: SOOCHOW UNIVERSITY, Suzhou (CN)

(72) Inventors: Zhanxiong Li, Suzhou (CN); Jialiang Kang, Suzhou (CN)

(73) Assignee: SOOCHOW UNIVERSITY, Suzhou (CN)

( * ) Notice: Subject to any disclaimer, the term of this patent is extended or adjusted under 35 U.S.C. 154(b) by 334 days.

This patent is subject to a terminal disclaimer.

(21) Appl. No.: 18/035,742

(22) PCT Filed: May 10, 2022

(86) PCT No.: PCT/CN2022/091887

§ 371 (c)(1),
(2) Date: May 6, 2023

(87) PCT Pub. No.: WO2023/155308

PCT Pub. Date: Aug. 24, 2023

(65) Prior Publication Data

US 2024/0344264 A1 Oct. 17, 2024

(30) Foreign Application Priority Data

Feb. 15, 2022 (CN) ..... 202210138213.5

(51) Int. Cl.
*D06M 13/372* (2006.01)
*D06M 11/38* (2006.01)
(Continued)

(52) U.S. Cl.
CPC ..... *D06M 13/372* (2013.01); *D06M 11/38* (2013.01); *D06M 13/133* (2013.01);
(Continued)

(58) Field of Classification Search
CPC .. D06M 13/372; D06M 11/38; D06M 13/133; D06M 13/188; D06M 13/338;
(Continued)

(56) References Cited

U.S. PATENT DOCUMENTS

2017/0081435 A1* 3/2017 Wen ..... B05D 3/06
2024/0344265 A1* 10/2024 Li ..... D06M 13/133

FOREIGN PATENT DOCUMENTS

CN 105189625 A 12/2015
CN 112048910 A 12/2020
(Continued)

*Primary Examiner* — Matthew D Matzek
(74) *Attorney, Agent, or Firm* — SZDC Law PC

(57) ABSTRACT

A fluorine-free carbon chain hydrophobic fabric, and its preparation method and application. A fabric is sequentially soaked in an alkali liquor and an acid liquor to obtain a pretreated fabric; the pretreated fabric then reacts with bromoacetyl bromide to obtain a treated fabric; the treated fabric then reacts with 1,2-bis(p-toluenesulfonyl) hydrazine to obtain a diazotized fabric; the diazotized fabric reacts with a diazoacetate monomer to obtain a fluorine-free carbon chain hydrophobic fabric; and the diazoacetate monomer is butyl diazoacetate, hexyl diazoacetate, octyl diazoacetate, dodecyl diazoacetate, tetradecyl diazoacetate or octadecyl diazoacetate. According to the scheme, diazoacetate is used as a monomer, and different fiber grafting modification processes are used, so as to form different structures on the fiber surface; and the comprehensive properties such as thermal stability, air permeability and breaking strength of the finished fabric are tested, the heat
(Continued)

resistance and breaking strength of the finished fabric are reduced, and the air permeability is good.

10 Claims, 10 Drawing Sheets

(51) Int. Cl.
*D06M 13/133* (2006.01)
*D06M 13/188* (2006.01)
*D06M 13/338* (2006.01)
*D06M 101/06* (2006.01)

(52) U.S. Cl.
CPC ..... *D06M 13/188* (2013.01); *D06M 13/338* (2013.01); *D06M 2101/06* (2013.01); *D06M 2200/12* (2013.01)

(58) Field of Classification Search
CPC ..... D06M 2101/06; D06M 2200/12; D06M 13/422; D06M 13/322
USPC ..... 442/79, 85, 86; 428/221
See application file for complete search history.

(56) References Cited

FOREIGN PATENT DOCUMENTS

| | | | |
|---|---|---|---|
| CN | 112080937 | A | 12/2020 |
| CN | 112878053 | A | 6/2021 |
| CN | 114427167 | A | 5/2022 |
| GB | 2291655 | A | 1/1996 |

* cited by examiner

FLUOROCARBON CHAIN-FREE HYDROPHOBIC FABRIC, PREPARATION AND APPLICATION THEREOF

TECHNICAL FIELD

The present invention belongs to the hydrophobic technology, and specifically relates to a fluorine-free carbon chain hydrophobic fabric and its preparation method and application.

BACKGROUND OF INVENTION

In recent years, constructing polymer structures connected by covalent bonds through covalent on-surface polymerization has become a hot research topic in surface molecular science. Thanks to the rapid development of scanning probe microscopy technology, researchers have gradually begun to explore the process of covalent on-surface polymerization at the atomic level. The carbene polymerization of α-diazo carbonyl compounds is an efficient polymerization method that has attracted great attention from scholars in recent years. However, its reaction mechanism and the application of carbene polymerization still require continuous research and exploration by researchers. The existing technology disclosed a waterproof fabric material and its preparation method, and it consists of a substrate and a water repellent fabric. The water repellent fabric consists of a fabric and a fluorine-containing polymer covalently grafted onto the fabric surface through carbene polymerization. The fluorine-containing polymer with a single carbon repeating unit is covalently grafted onto the fabric surface through carbene polymerization to produce a hydrophobic modified fabric. In the water repellent treatment of fabrics, long-chain perfluoroalkyl (C≥8) polymer is one of the most ideal low surface energy polymeric materials, but this type of compound has high stability, and it makes itself difficult to degrade through conventional degradation methods such as photodegradation, chemical degradation, and microbial degradation on the contrary, which contradicts the growing demand for green and pollution-free environment in the society.

Technical Problems

The present invention adopts low surface energy fluorine-free long carbon chain monomers for chemical grafting on the fiber surface of fabrics, which can effectively solve the problem of environmental pollution, and generates a roughened surface morphology on the fiber surface after grafting in situ, which can be repellent to water synergistically with the chemical protection of the low-surface-energy polymers on the fiber surface. The present invention first synthesized 1,2-bis (p-Toluenesulfonyl) hydrazine from p-Toluenesulfonyl hydrazine and p-Toluenesulfonyl chloride as raw materials, with pyridine as a catalyst. Then, C—Br bonds were introduced on the fiber surface, and the latter was transformed into diazo groups by 1,2-bis (p-Toluenesulfonyl) hydrazine treatment under the catalysis of DBU. Through EDS analysis, it was found that grafting sites were successfully constructed on the fiber surface. Hexanol was used as a raw material for the substitution reaction with bromoacetyl bromide to produce hexyl bromoacetate intermediate, which was then synthesized with 1,2-bis (p-Toluenesulfonyl) hydrazine under the catalysis of DBU to produce hexyl diazoacetate, and the product structure was characterized by FT-IR and NMR. Then, butanol, octanol, dodecanol, tetradecanol, and octadecanol were selected as raw materials to react with bromoacetyl bromide to prepare alkyl bromoacetate. Then, it reacted with 1,2-bis (p-Toluenesulfonyl) hydrazine under the catalysis of DBU to produce diazoacetate esters with different carbon chain lengths (butyl diazoacetate, capryl diazoacetate, dodexyl diazoacetate, myristyl diazoacetate, and octadexyl diazoacetate). The target product was successfully synthesized through FT-IR and NMR, and cotton fibers were graft modified with different diazoacetate monomers, and the polymer was successful grafted through EDS, ATR, and XPS; Through SEM, AFM, and ImageJ analysis of the surface morphology of the fabric, it was found that the fiber surface after grafting with butyl diazoacetate exhibited a "roughened" morphology, with an average size of 351.57±87.13 nm, and the spatial structure of the fiber surface collapsed after grafting with capryl diazoacetate, and the fabric surface became a membrane structure after grafting with dodexyl diazoacetate, myristyl diazoacetate, and octadexyl diazoacetate and the surface RMS (roughness) also decreased from 48.7 nm to 12.1 nm. The water contact angles of the fabrics grafted with butyl diazoacetate, capryl diazoacetate, dodexyl diazoacetate, myristyl diazoacetate, and octadexyl diazoacetate were tested to be 116.2±0.8°, 124.0±2.1°, 129.3±1.1°, 130.1±0.9°, 131.2±1.3°, and 133.4±1.8°, respectively. After the pendant group carbon chains of the grafted polymer were ≥8, continuing to extend the pendant group carbon chains could not improve the hydrophobic property of the grafted fabrics. Using diazoacetate as a monomer and using different fiber graft modification processes, the different structures exhibited on the fiber surfaces; The comprehensive properties of the treated fabrics, including thermal stability, permeability, and breaking strength, were tested and the heat resistance and breaking strength of the treated fabric decreased, while the permeability was good.

Technical Solution

The present invention adopts the following technical scheme: a fluorine-free carbon chain hydrophobic fabric, and the diazotized fabric reacts with diazoacetate monomer to obtain the fluorine-free carbon chain hydrophobic fabric; and the diazoacetate monomer is butyl diazoacetate, hexyl diazoacetate, capryl diazoacetate, dodexyl diazoacetate, myristyl diazoacetate, or octadexyl diazoacetate.

The present invention discloses the application of diazoacetate monomer in the preparation of fluorine-free carbon chain hydrophobic fabric; and the diazoacetate monomer is butyl diazoacetate, hexyl diazoacetate, capryl diazoacetate, dodexyl diazoacetate, myristyl diazoacetate, or octadexyl diazoacetate.

The present invention disclosed the application of the above-mentioned fluorine-free carbon chain hydrophobic fabrics in the preparation of hydrophobic flexible materials; the fabrics of the present invention are natural fiber fabrics, chemical fiber fabrics, or a blend thereof, such as cotton fabrics.

In the present invention, the fabric was sequentially soaked in alkaline solution and acid solution to obtain a pre-treated fabric; then, the pre-treated fabric was reacted with bromoacetyl bromide to obtain the treated fabric; the pre-treated was reacted with 1,2-bis (p-Toluenesulfonyl) hydrazine to obtain the diazotized fabric; preferably, the alkaline solution was sodium hydroxide aqueous solution, and the acid solution was glacial acetic acid aqueous solution; when the pre-treatment fabric was reacted with bromoacetyl bromide, sodium bicarbonate was used as an acid binding agent, and the reaction was carried out at −5° C. to 25° C. for 1-24 hours; the reaction between the pre-treated fabric and 1,2-bis (p- Toluenesulfonyl) hydrazine was carried out in the presence of DBU, and the reaction was carried out at 0-25° C. for 1-24 hours.

In the present invention, the molar ratio of diazoacetate monomer to diazotized cotton fabric surface hydroxyl was 5-40:1, preferably 10-30:1, and further preferably 20-30:1. The reaction of diazotized fabric and diazoacetate monomer was carried out under nitrogen gas, in a solvent, in the presence of palladium catalyst and reducing agent. Preferably, the solvent was tetrahydrofuran, the palladium catalyst was $(\pi\text{-allylPdCl})_2$, and the reducing agent was $NaBPh_4$; The reaction process between diazotized fabric and diazoacetate monomer was at 0° C., 5° C., and 15° C. for 1 hour each, and then at 30° C. for 12-36 hours.

Beneficial Effects

At present, the main method of graft polymerization on the surface of fabrics is olefin polymerization (C2 polymerization), but it is difficult to undergo polymerization when the C═C double bond of olefins contains multiple polar functional groups. The present invention adopts the carbene polymerization of α-carbonyl diazo compounds to solve this problem, in which the main polymer chain is composed of a carbon atom as the structural unit, and the pendant groups of the main chain of polymer are more intensive. Fluoroalkyl based polymers have excellent chemical liquid repellency and are the most common fabric water repellent treatment agents. However, they have environmental pollution issues and have been banned. Therefore, the present invention uses low surface energy fluorine-free long carbon chain monomers instead of long carbon chain perfluoroalkyl monomers for graft polymerization on the fiber surface to obtain the superhydrophobic fabric on the premise of effectively solving environmental pollution. Firstly, a reactive base is constructed on the surface of fabric fibers, and then long carbon chain monomers are graft polymerized on the fiber surface to explore the relationship between different processes and the surface morphology of modified fibers. It also explores the relationship between the surface structure of graft modified fibers and properties after polymerization of carbene monomers with different carbon chain lengths, especially the physical structure patterns of the surface formed by polymerization of monomers with different carbon chain lengths, and the resulting surface characteristics.

EXAMPLES OF THE PRESENT INVENTION

Figure 1:
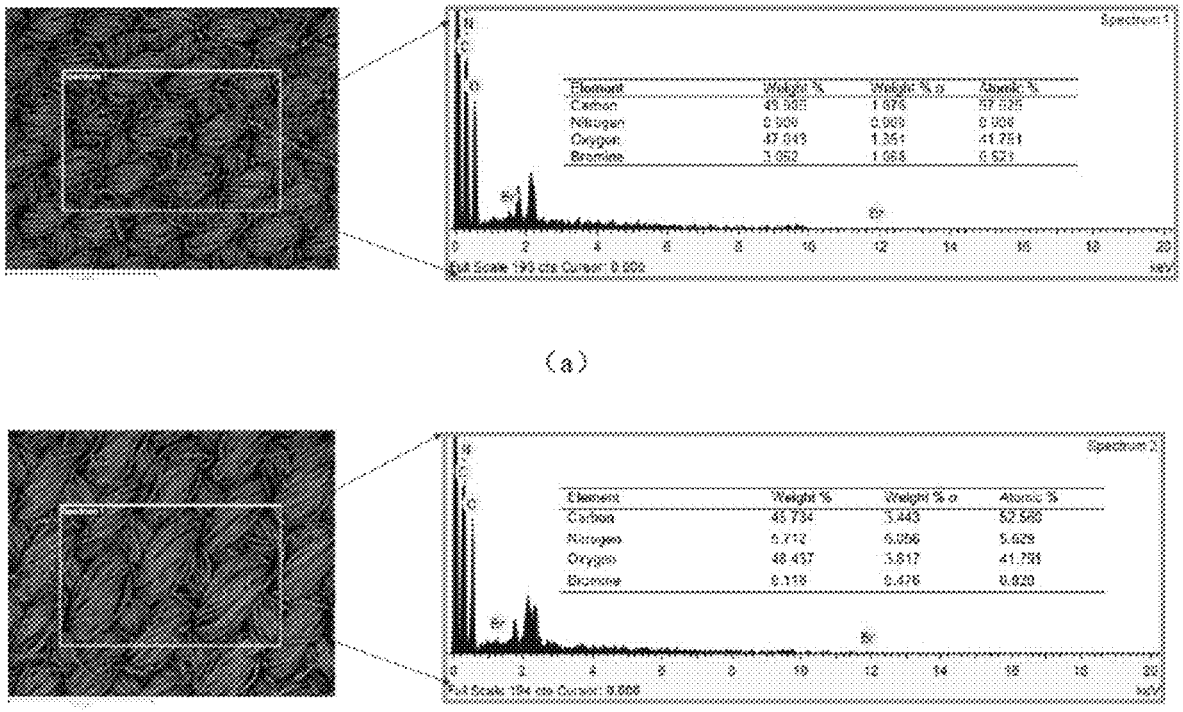
FIG. 1 shows the SEM-EDS image of the fiber surface: (a) Cotton-Br and (b) Cotton=$N_2$.

Cotton fabric (commercially available, untreated), and pyridine and 1-butanol were purchased from J&K Chemical Ltd., and p-Toluenesulfonyl hydrazine, p-toluenesulfonyl chloride, sodium tetraphenylborate, allylpalladium (II) chloride dimer were purchased from Shanghai Aladdin Bio-Chem Technology Co., LTD, and sodium chloride, sodium bicarbonate, dichloromethane (high-purity), anhydrous ethanol, and DBU were purchased from Sinopharm Chemical Reagent Co., Ltd., anhydrous sodium sulfate, tetrahydrofuran (high-purity), anhydrous ether, and anhydrous methanol were purchased from Chinasun Specialty Products Co., Ltd., and n-butanol, 1-octanol, dodecanol, tetradecanol, and octadecanol were purchased from Shanghai Aladdin Biochemical Technology Co., Ltd. Unless otherwise specified, all reagents were of analytical grade.

The molecular formula of cellulose is $(C_6H_{12}O_{12})_n$, and when M g of alkalized cotton fabric is taken, the amount of hydroxyl groups on its surface is calculated as: $M/162\times10^3$ mmol.

Fourier Transform Infrared (FTIR) Analysis

KBr (or a mixture of KBr and solid samples) was ground into powder in a mortar and baked under a heating lamp until dry. An appropriate amount of KBr powder was weighed and pressed for 10 seconds under a pressure of 1 ton. The liquid sample was dripped on the KBr tablet through a capillary tube and placed inside an infrared spectrometer for testing. Analysis results obtained through nuclear magnetic hydrogen spectrum ($^1$H-NMR). A small amount of the sample to be tested was taken and dissolved in chloroform-d ($CDCl_3$) or dimethyl sulfoxide-d6 (DMSO), and tested using an INOVA-400 nuclear magnetic resonance spectrometer with tetramethylsilane (TMS) as the internal standard.

Attenuated Total Reflectance (ATR) Test

The fabric to be tested was placed in an oven and dried at low temperature. After removal, it was placed on the test bench of the Nicolet iS5 infrared spectrometer. The test hole was covered and pressed tightly. The instrument resolution was set to 4 $cm^{-1}$, the scanning range was 4000-500 $cm^{-1}$, and it was scanned 12 times (SEM). A square fabric with a side length of 5 mm was taken and stuck onto the electron microscope table with conductive adhesive. The vacuum pumping and metal spraying were carried out six times, and S4800 field emission scanning electron microscope was used to test the microstructure of the fiber surface.

Water Contact Angle (WCA) Test

The fabric to be tested was fixed flat on a microscope slide and placed on the sample table of OCA40 droplet wettability tester with the camera aligned. The deionized water was used as the test droplet, with a volume of 3 μL. The angle was calculated through instrument software, and each sample was tested 5 times, taking the average value and calculating the error.

Atomic Force Microscopy (AFM) Observation

The fiber surface morphology and three-dimensional structure of the fabric to be tested were observed using a Nanoscope V-type atomic force microscope. A sample with a diameter of approximately 1 cm was fixed flat on a matching iron plate, and the surface roughness was calculated using an instrument. The scanning range was set to 2 μm×2 μm.

Thermogravimetric Analysis (TGA)

The fabric to be tested was cut into powder form, and about 5 mg of the sample was taken and placed in a crucible. Then it was placed in a Diamond 5700 thermogravimetric analyzer, and the test gas was set to air, with a temperature range of 30° C.-600° C. and a heating rate of 20° C./min.

Determination of fabric permeability. According to the standard GB/T 5453-1997 "Determination of Permeability of Fabrics to Air", a test sample with an area of 20 $cm^2$ was placed on the test table of a fully automatic permeability meter, the test pressure difference was set to 100 pa, and the average of five tests for each sample was taken.

Breaking Strength of Fabric

The fabric to be tested was clamped on the GP-6114S-300K universal material testing machine, the force sensing range was set to 1000N, the stretching speed was set to 100 mm/min, the clamping length was 50 mm, the fabric width was 45 mm, and 5 tests were made for each sample in the warp and weft directions and the average value was taken.

During the X-ray photoelectron spectroscopy (XPS) analysis, Al-Kα (hv=1486.6 eV) monochromatic X-ray source was used to analyze the surface elements of the fabric before and after grafting, with a pressure setting of $4.0\times10^{-9}$ Pa and an incidence angle of 90°.

Synthesis example: Synthesis of 1, 2-bis (p-Toluenesulfonyl) hydrazine (TsNHNHTs) and the synthesis route is shown in the following:

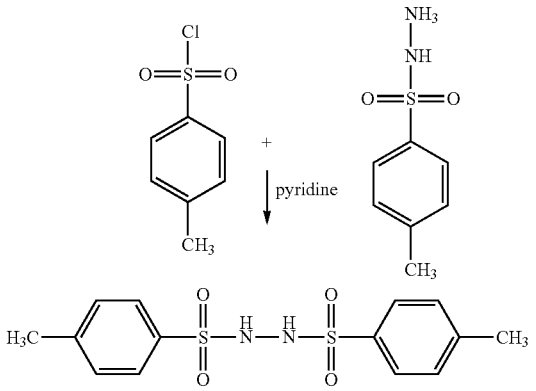

Synthesis Steps

Under the nitrogen protection, 18.64 g (100.00 mmol) of p-Toluenesulfonyl hydrazine and 28.60 g (150.00 mmol) of p-toluenesulfochloride were added to a 1000 ml three-necked flask. 120 mL of dichloromethane (dehydrated) was used as the solvent, and 11.96 g (150.00 mmol) of pyridine was dropped dropwise under nitrogen gas protection in 10 minutes. After stirring at room temperature for 3 hours, 300 mL of anhydrous ether was added to make the solution turbid. After cooling to 0° C., 200 mL of deionized water was added and then it was filtered to obtain a light-yellow floccule. Then it continued to be filtered with 150 mL of anhydrous ether to obtain a white solid, which was placed in an oven and dried at 30° C. The white solid after drying was dissolved in 400 mL of methanol and heated to boiling until the solid was completely dissolved, then it was cooled to room temperature for crystallization. The 24 g white crystallized product was finally obtained with a yield of: 70.0%. Product FT-IR (KBr, $cm^{-1}$): 3229, 3205 (N—H); 3065, 2942 (Ph-H); 1512 (—$CH_3$); 1607, (C—C); 1345, 1210, 1188 (Ph-$SO_2$—N); 1043 (S—N). 1H NMR (400 MHZ, DMSO): 1.47 (—$CH_3$); 6.32 (Ph-H); 6.93 (Ph-H); 8.69 (N—H) ppm.

Synthesis of hexyl diazoacetate (HDA) and the synthesis route is shown in the following:

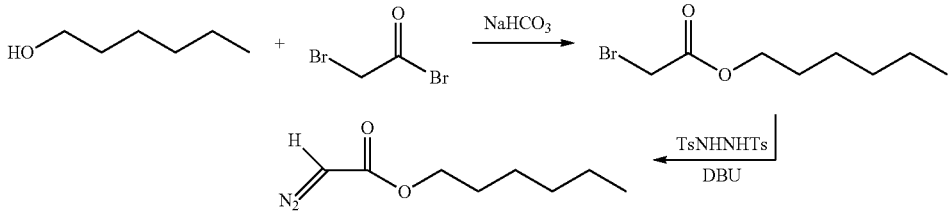

Synthesis of Hexyl Bromoacetate (Intermediate)

Hexanol (2.00 g, 20 mmol) was added to a three-necked flask containing 100 mL of dehydrated dichloromethane. Then 5.04 g (60 mmol) of sodium bicarbonate was added as an acid-binding agent. After that, the temperature was lowered to −5° C. in a nitrogen environment. Then, the bromoacetyl bromide (3.5 mL, 40.4 mmol) pre-dissolved in the 5 ml dehydrated dichloromethane was added into the three-necked flask through a syringe and the temperature was raised to the room temperature for 24-hour stirring. Then, 60 mL deionized water was added and the solution was transferred to a 1000 ml separating funnel. It was extracted with dichloromethane three times and dried with anhydrous sodium sulfate. After filtration and rotary evaporation, purification was carried out using silica gel column chromatography. The eluent ratio was dichloromethane: n-hexane=3:1 (v/v). After rotary distillation, a light-yellow oily product (monomer) of 2.72 g was obtained, with a yield of: 61%. Product FT-IR (KBr, $cm^{-1}$): 3134, 2659 (C—H); 1728 (C═O); 1291 (CO—O); 1113 (O—C—C). 1H NMR (400 MHZ, $CDCl_3$): 3.78 (Br—$CH_2$) ppm.

Synthesis of Hexyl Diazoacetate (Monomer)

The hexyl bromoacetate (2.00 g, 6.51 mmol) obtained from the previous step and N, N'-dimethylbenzene sulfonyl hydrazide (4.44 g, 13 mmol) was dissolved in 60 mL of dehydrated tetrahydrofuran, and added into a 50 ml three-necked flask, and cooled to −5° C. in an ice bath. The DBU (6.70 mL, 44.8 mmol) diluted in 10 ml of dehydrated tetrahydrofuran was added into the reaction bath through a 20 ml syringe, then heated up to 10° C. for 2-hour reaction, transferred to a reciprocating shaker bath, and slowly heated up to 25° C. for 24-hour reaction. 20 ml of deionized water was added to stop the reaction, extracted three times with dichloromethane, and dried with anhydrous sodium sulfate. After filtration and rotary evaporation, the product was purified by silica gel chromatography. A mixed solvent of ethyl acetate/dichloromethane=1:5 (v/v) was selected as the eluent, and the main elution band was evaporated to obtain 0.68 g of dark brown oily product with a yield of 41%. Product FT-IR (KBr, $cm^{-1}$): 3144, 3012 (C—H); 2121 (C═$N_2$); 1644 (C—O); 1391 (—$CH_2$); 1271 (CO—O); 1113 (O—C—C). 1H NMR (400 MHZ, $CDCl_3$): 4.68 (H—C═$N_2$) ppm.

Synthesis of Butyl Diazoacetate (BDA)

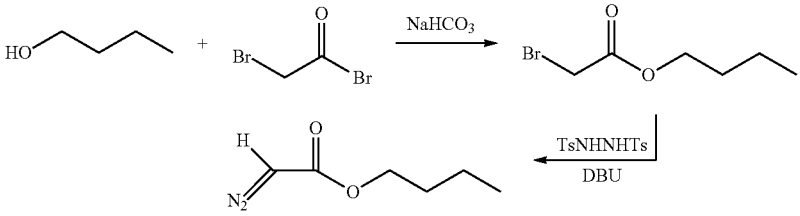

Synthesis of Butyl Bromoacetate (Intermediate)

5.04 g (60 mmol) of sodium bicarbonate and 1.48 g (20 mmol) of n-butanol were added to a three-necked flask containing 100 mL of dehydrated dichloromethane, respectively. 3.5 mL (40.4 mmol) of bromoacetyl bromide was added at −5° C. for 1-hour reaction, and heated up to 5° C., 15° C., and 25° C. for 1-hour reaction each, then heated up to 30° C. for 24-hour oscillatory reaction. 50 ml of deionized water was added to stop the reaction, and it was extracted three times with dichloromethane, dried with anhydrous sodium sulfate, filtered and evaporated, and purified through silica gel column chromatography. The eluent was a mixed solvent (dichloromethane: n-hexane=4:1, v/v). After purification, a light-yellow oily product of 2.72 g was obtained with a yield of 71.0%. Product FT-IR (KBr, $cm^{-1}$): 3133, 2659 (C—H); 1728 (C═O); 1288 (CO—O); 1110 (O—C—C). 1H NMR (400 MHZ, $CDCl_3$): 4.09 (Br—$CH_2$) ppm.

Synthesis of Butyl Diazoacetate (Monomer)

2.72 g (14.2 mmol) of butyl bromoacetate from the previous step was dissolved in 100 ml of dehydrated tetrahydrofuran, 8.85 g (23 mmol) of N, N'-toluenesulfonyl hydrazine was added, and it was dissolved in a three-necked flask and cooled down to −5° C. 6.70 mL DBU was diluted in 10 ml of dehydrated tetrahydrofuran and added dropwise into a three-necked flask with an injector under nitrogen conditions. The reaction solution in the flask quickly turned yellow, accompanied by the generation of bubbles. After it was heated to 25° C. and reacted for 24 hours, 30 ml of deionized water was added for dilution. It was extracted three times with dichloromethane, and the anhydrous sodium sulfate was added for drying, and after filtration and rotary evaporation, it was purified with silica gel chromatography (ethyl acetate:dichloromethane=1:5, v/v) to obtain 0.82 g of butyl bromoacetate with a yield of 49.1%. Product FT-IR (KBr, $cm^{-1}$): 3130, 2959 (C—H); 2111 (C═$N_2$); 1641 (C═O); 1400 (—$CH_2$); 1271 (CO—O); 1110 (O—C—C). 1H NMR (400 MHZ, $CDCl_3$): 4.73 (H—C═$N_2$) ppm.

Synthesis route of capryl diazoacetate, dodexyl diazoacetate, myristyl diazoacetate, and octadexyl diazoacetate is shown in the following:

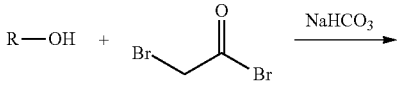

-continued

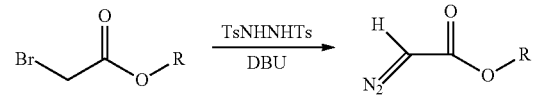

R = $C_8H_{19}$, $C_{12}H_{25}$, $C_{14}H_{29}$, $C_{18}H_{37}$ (1) Synthesis of Octyl Bromoacetate, Dodecyl Bromoacetate, Tetradecyl Bromoacetate, and Octadecyl Bromoacetate: 2.6 g (20 mmol) of octanol, 3.72 g (20.0 mmol) of dodecanol, 4.28 g (20.0 mmol) of tetradecanol, and 5.42 g (20.0 mmol) of octadecanol were added into a three-necked flask containing 100 mL of dehydrated dichloromethane, respectively and shaken evenly until it was dissolved, and cooled down to −10° C. in a nitrogen environment. The bromoacetyl bromide (3.5 mL 40.4 mmol) diluted in 10 ml of dehydrated dichloromethane was added dropwise into a three-necked flask through a syringe, and stirred for 1 hour, heated up to 5° C., 15° C., and 25° C. for 1 hour each, then heated to 30° C. for 24-hour oscillatory reaction. 50 mL of deionized water was added, and then it was extracted three times with dichloromethane, and dried with anhydrous sodium sulfate. After filtration and rotary evaporation, the product was purified by silica gel chromatography (dichloromethane:n-hexane=1:1, v/v) to obtain 3.21 g of octyl bromoacetate with a yield of 62%; dodecyl bromoacetate 3.62 g, with a yield of 59%; tetradecyl bromoacetate 3.15 g, with a yield of 47%; octadecyl bromoacetate 3.28 g, with a yield of 42%.

Octyl Bromoacetate: Product FT-IR (KBr, $cm^{-1}$): 2971 (C—H); 1744 (C—O); 1249 (CO—O); 1141 (O—C—C). $^1$HNMR (400 MHZ, $CDCl_3$): 4.10 (Br—$CH_2$); 4.33 (—$CH_2$) ppm.

Dodecyl Bromoacetate: Product FT-IR (KBr, $cm^{-1}$): 3120, 2981 (C—H); 1751 (C═O); 1402 (—$CH_2$); 1285 (CO—O); 1135 (O—C—C). 1H NMR (400 MHZ, $CDCl_3$): 4.14 (Br—$CH_2$); 4.38 (—$CH_2$) ppm.

Tetradecyl Bromoacetate: Product FT-IR (KBr, $cm^{-1}$): 3142, 3083 (C—H); 1851 (C═O); 1433 (—$CH_2$); 1011 (CO—O); 1201 (O—C—C); 1H NMR (400 MHZ, $CDCl_3$): 4.09 (Br—$CH_2$); 4.28 (—$CH_2$) ppm.

Octadecyl Bromoacetate: Product FT-IR (KBr, $cm^{-1}$): 3128, 2963 (C—H); 1737 (C═O); 1411 (—$CH_2$); 1183 (CO—O); 1182 (O—C—C). 1H NMR (400 MHZ, $CDCl_3$): 4.10 (Br—$CH_2$); 4.17 (—$CH_2$) ppm.

(2) The synthesis of capryl diazoacetate, dodexyl diazoacetate, myristyl diazoacetate, and octadexyl diazoacetate: the above four products were dissolved in 100 mL of dehydrated tetrahydrofuran, 8.85 g (23 mmol) of N, N'-toluenesulfonyl hydrazine was added and cooled down to 0° C. 6.70 mL (44.8 mmol) of DBU was added under nitrogen protection, heated up to the room temperature, and stirred for 24 hours. 20 mL of deionized water was added, and it was extracted three times with dichloromethane, and dried with anhydrous magnesium sulfate. After filtration and rotary evaporation, it was purified by silica gel chromatography (ethyl acetate: dichloromethane=1:5, v/v) to obtain 1.28 g of dark brown oily product of Capryl diazoacetate (CDA) with a yield of 54%; 1.46 g of brown oily product Dodecyl diazoacetate (DDA) with a yield of 48%; 1.04 g of yellow oily product Myristyl diazoacetate (MDA) with a yield of 41%; 1.21 g of light-yellow oily product octadecyl diazoacetate (ODA) with a yield of 45%.

CDA: Product FT-IR (KBr, $cm^{-1}$): 3119, 2959 (C—H); 2117 (C═$N_2$); 1721 (C═O); 1264 (CO—O); 1077 (O—C—C). 1H NMR (400 MHZ, $CDCl_3$): 4.37 (—$CH_2$); 4.72 (H—C═$N_2$) ppm.

DDA: Product FT-IR (KBr, $cm^{-1}$): 2944 (C—H); 2131 (C═$N_2$) 1728 (C—O); 1411 (—$CH_2$); 1228 (CO—O); 1234 (O—C—C). 1H NMR (400 MHZ, $CDCl_3$): 4.46 (—$CH_2$); 4.78 (H—C═$N_2$) ppm.

MDA: Product FT-IR (KBr, $cm^{-1}$): 3122, 3063, 2956 (C—H); 2228 (C═$N_2$); 1741 (C═O); 1401 (—$CH_2$); 1245 (CO—O); 1024 (O—C—C). 1H NMR (400 MHZ, $CDCl_3$): 4.44 (—$CH_2$); 4.79 (H—C═$N_2$) ppm.

ODA: Product FT-IR (KBr, $cm^{-1}$): 3142, 2978, 2912 (C—H); 2223 (C═$N_2$); 1731 (C═O); 1405 (—$CH_2$); 1246 (CO—O); 1041 (O—C—C). 1H NMR (400 MHZ, $CDCl_3$): 4.43 (—$CH_2$); 4.62 (H—C═$N_2$) ppm.

Example 1

100 g of sodium hydroxide and 500 ml of deionized water were added to a 1000 ml beaker, and stirred until it was dissolved. The untreated cotton fabric was immersed in the solution for 1 hour, and then it was taken out and washed with deionized water five times, then the alkalized cotton fabric was put in and soaked in 5% acetic acid for 30 minutes, and washed with deionized water five times to obtain the pretreated fabric to be dried at room temperature for standby.

The pretreated fabric (0.415 g) was soaked in anhydrous tetrahydrofuran, and subjected to the ultrasonic cleaning for 30 minutes, and dried at room temperature for standby. The pretreated fabric was put into a conical flask containing 100 mL of anhydrous tetrahydrofuran. After the fabric was completely soaked, 0.83 g of sodium bicarbonate was used as an acid binding agent. The nitrogen gas was let in to empty the air in the flask to cool down to −5° C. After the temperature became stable, 3.25 g of bromoacetyl bromide was dissolved in 5 ml of dehydrated tetrahydrofuran, and then it was added to a conical flask through an injector for 1-hour reaction. Then the temperature was raised to 10° C. for 1-hour reaction. After that, the temperature was raised to 25° C. for 24-hour reaction. The fabric was taken out and washed with tetrahydrofuran and dried to obtain the treated cotton fabric. The SEM-EDS image of the fiber surface is shown in FIG. 1*a*.

The treated cotton fabric was put into a conical flask, 50 mL of anhydrous tetrahydrofuran and 2.71 g 1,2-bis (p-Toluenesulfonyl) hydrazine were added, and the nitrogen gas was let in to empty the air in the flask, then it was transferred to a low-temperature reactor to cool to −10° C. DBU dissolved in 10 ml anhydrous tetrahydrofuran was added dropwise into a conical flask through an injector. The flask was shaken until 1,2-bis(p-Toluenesulfonyl) hydrazine was completely dissolved, and the solution gradually turned yellow. Then the temperature was raised to 0° C. for 1-hour reaction. After that, the temperature was raised to 25° C. for 24-hour reaction. The fabric was taken out and washed with tetrahydrofuran and dried to obtain the diazotized cotton fabric. The SEM-EDS image of the fiber surface is shown in FIG. 1*b*.

0.26 g of the above diazotized cotton fabric (containing 2 mmol of hydroxyl groups) was taken and added into a 150 ml conical flask. Then 20 mmol of hexyl diazoacetate monomer was added and 100 mL anhydrous tetrahydrofuran was used as the solvent. The molar ratio of the monomer to the surface hydroxyl group of the diazotized cotton fabric in the flask was 10:1. Under the nitrogen condition, 9.15 mg (0.025 mmol) (π-allylPdCl) 2 was added and cooled down to −10° C. Then $NaBPh_4$ 32.5 mg (0.09 mmol) was added and dissolved and then heated up to 0° C., 5° C. and 15° C. for 1-hour reaction respectively. Finally, the conical flask was transferred to a reciprocating shaker bath and heated up to 30° C. for a 12-hour reaction. After treatment, the fabric was ultrasonically cleaned in tetrahydrofuran for 2 minutes, and then dried at low temperature in an oven to obtain a hydrophobic fabric with a water contact angle of 105.0°.

Example 2

0.26 g of the above diazotized cotton fabric (containing 2 mmol of hydroxyl groups) from the Example 1 was taken and added into a 150 ml conical flask. Then 40 mmol of hexyl diazoacetate monomer was added and 100 mL anhydrous tetrahydrofuran was used as the solvent. The molar ratio of the monomer to the surface hydroxyl group of the diazotized cotton fabric in the flask was 20:1. Under the nitrogen condition, 9.15 mg (0.025 mmol) (π-allylPdCl) 2 was added and cooled down to −10° C. Then $NaBPh_4$ 32.5 mg (0.09 mmol) was added and dissolved and then heated up to 0° C., 5° C. and 15° C. for 1-hour reaction respectively. Finally, the conical flask was transferred to a reciprocating shaker bath and heated up to 30° C. for a 12-hour reaction. After treatment, the fabric was ultrasonically cleaned in tetrahydrofuran for 2 minutes, and then dried at low temperature in an oven to obtain a hydrophobic fabric with a water contact angle of 110.4°.

Example 3

0.26 g of the above diazotized cotton fabric (containing 2 mmol of hydroxyl groups) from the Example 1 was taken and added into a 150 ml conical flask. Then 60 mmol of hexyl diazoacetate monomer was added and 100 mL anhydrous tetrahydrofuran was used as the solvent. The molar ratio of the monomer to the surface hydroxyl group of the diazotized cotton fabric in the flask was 30:1. Under the nitrogen condition, 9.15 mg (0.025 mmol) (π-allylPdCl) 2 was added and cooled down to −10° C. Then $NaBPh_4$ 32.5 mg (0.09 mmol) was added and dissolved and then heated up to 0° C., 5° C. and 15° C. for 1-hour reaction respectively. Finally, the conical flask was transferred to a reciprocating shaker bath and heated up to 30° C. for a 12-hour reaction. After treatment, the fabric was ultrasonically cleaned in tetrahydrofuran for 2 minutes, and then dried at low temperature in an oven to obtain a hydrophobic fabric with a water contact angle of 118°; the air permeability was $124.3 \pm 3.0\ mm \cdot s^{-1}$.

Example 4

Figure 2:
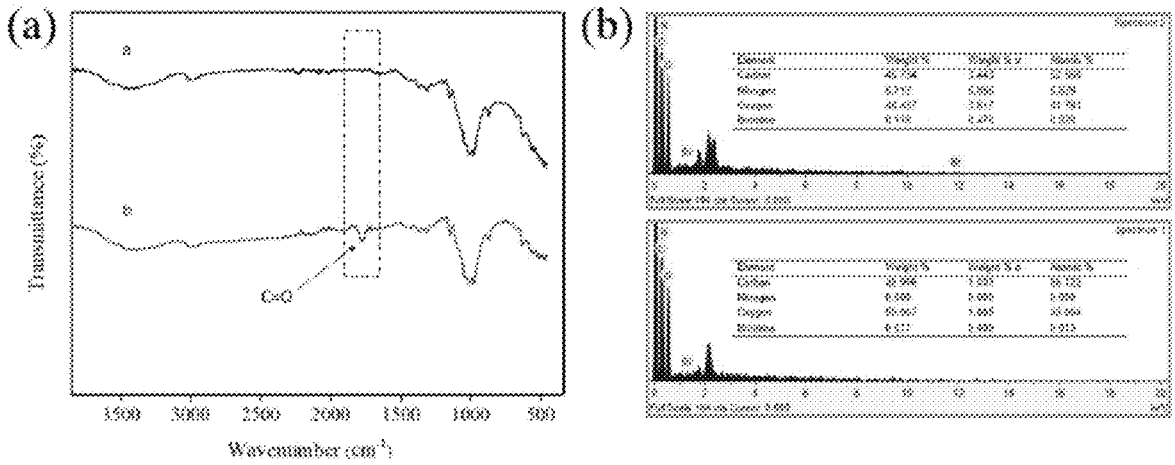
FIG. 2 shows the infrared total reflectance spectrum (a) and EDS element content spectrum of cotton fabric before and after grafting.
Figure 3:
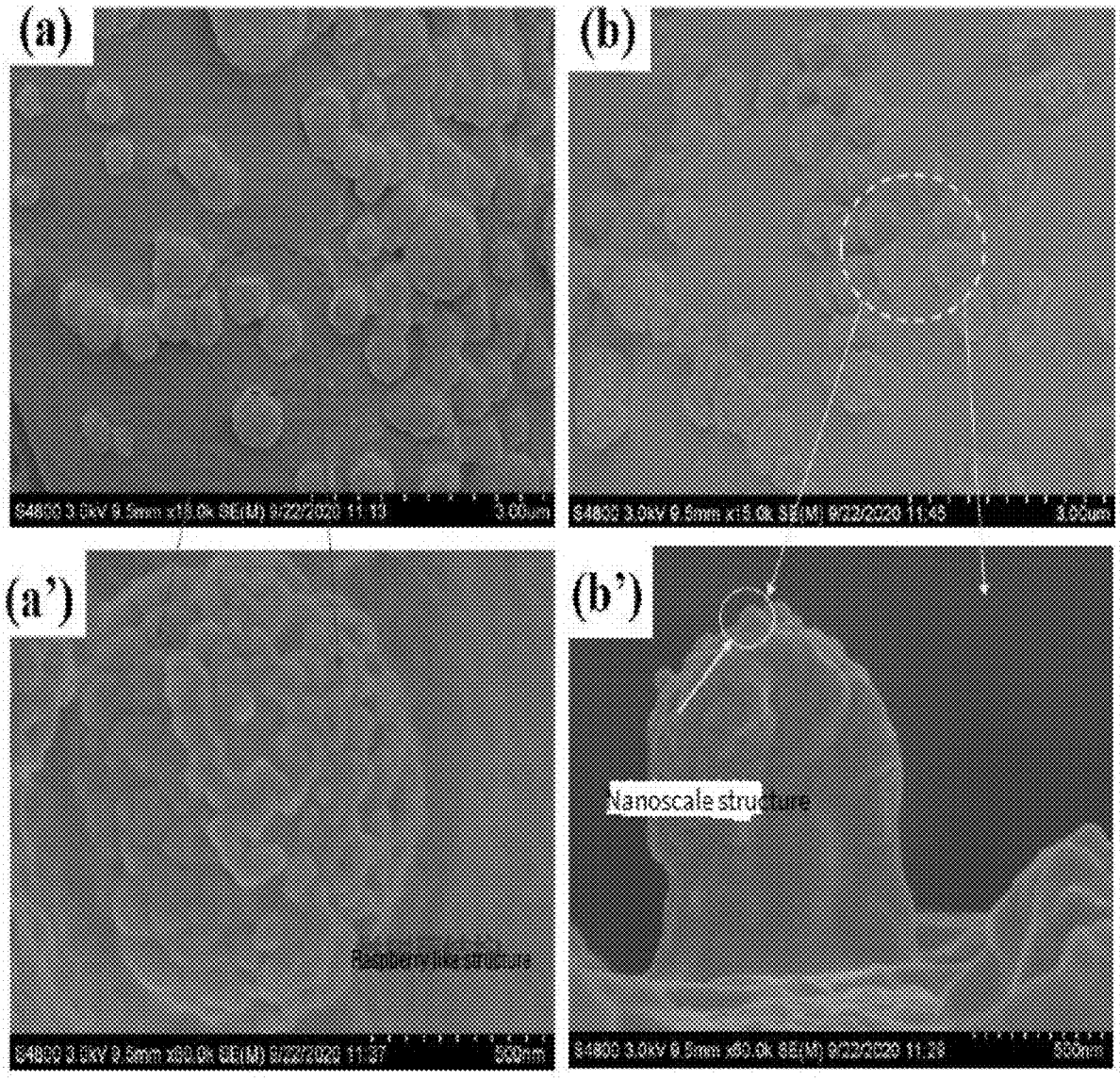
FIG. 3 shows the SEM image of the P (HDA)-cotton surface after 24 h (a×18000, a'×80000) and 36 h (b×15000, b'×60000) of reaction with the molar ratio of hexyl diazoacetate to fabric surface hydroxyl as 30:1.
Figure 4:
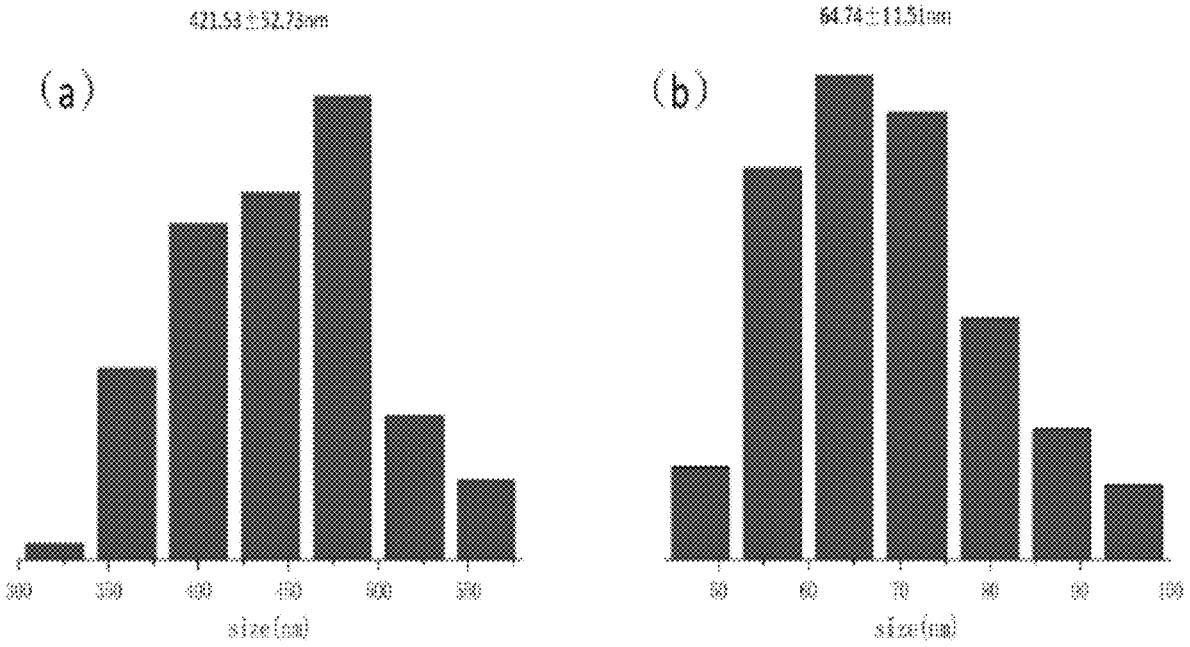
FIG. 4 shows the particle size distribution of micro-sized particles (a) and nano-sized particles (b) on the surface of P (HDA)-cotton in the ratio of 30:1 for 24-hour reaction.

0.26 g of the above diazotized cotton fabric (containing 2 mmol of hydroxyl groups) from the Example 1 was taken and added into a 150 ml conical flask. Then 60 mmol of hexyl diazoacetate monomer was added and 100 mL anhydrous tetrahydrofuran was used as the solvent. The molar ratio of the monomer to the surface hydroxyl group of the diazotized cotton fabric in the flask was 30:1. Under the nitrogen condition, 9.15 mg (0.025 mmol) (π-allylPdCl) 2 was added and cooled down to −10° C. Then $NaBPh_4$ 32.5 mg (0.09 mmol) was added and dissolved and then heated up to 0° C., 5° C. and 15° C. for 1-hour reaction respectively. Finally, the conical flask was transferred to a reciprocating shaker bath and heated up to 30° C. for a 24-hour reaction. After treatment, the fabric was ultrasonically cleaned in tetrahydrofuran for 2 minutes, and then dried at low temperature in an oven to obtain a hydrophobic fabric with a water contact angle of 124°. The infrared total reflectance (ATR) and surface EDS scanning images of cotton fabric before and after carbene grafting with hexyl diazoacetate were shown in FIG. 2. The SEM morphology of the fiber surface was shown in FIG. 3. The roughened particles on the fiber surface grew uniformly, and almost all roughened particles exhibited cluster bonding. The surface of the clusters regenerated nano-sized particles, forming a very complete "raspberry like" micro-nano composite structure; the average size of clusters and nano-sized particles covered on the surface of fabric fibers was calculated using ImageJ software, as shown in FIG. 4. The average size of clusters and nano-sized particles was 421.53±52.73 nm and 64.74±11.51 nm, respectively; The TGA curve showed that the thermal stability was similar before and after modification, but slightly decreased after modification. The residual carbon content of the fibers before and after modification was about 9%; The air permeability was 127.0±0.9 $mm \cdot s^{-1}$.

Example 5

0.26 g of the above diazotized cotton fabric (containing 2 mmol of hydroxyl groups) from the Example 1 was taken and added into a 150 ml conical flask. Then 60 mmol of hexyl diazoacetate monomer was added and 100 mL anhydrous tetrahydrofuran was used as the solvent. The molar ratio of the monomer to the surface hydroxyl group of the diazotized cotton fabric in the flask was 30:1. Under the nitrogen condition, 9.15 mg (0.025 mmol) (π-allylPdCl) 2 was added and cooled down to −10° C. Then $NaBPh_4$ 32.5 mg (0.09 mmol) was added and dissolved and then heated up to 0° C., 5° C. and 15° C. for 1-hour reaction respectively. Finally, the conical flask was transferred to a reciprocating shaker bath and heated up to 30° C. for a 36-hour reaction. After treatment, the fabric was ultrasonically cleaned in tetrahydrofuran for 2 minutes, and then dried at low temperature in an oven to obtain a hydrophobic fabric with a water contact angle of 123°. The SEM morphology of the fiber surface was shown in FIG. 3.

Example 6

60 mmol of the above five kinds of diazoacetate monomers (BDA, CDA, DDA, MDA, ODA) were diluted in 150 mL of dehydrated tetrahydrofuran solution, and 9.15 mg (25 μmol) (π-allylPdCl) 2 was added to the solution and stirred well. Then the solution was transferred to a conical flask and 0.26 g of diazotized cotton fabric (containing about 2 mmol of hydroxyl) from the Example 1 was added. After that, it was cooled down to −10° C. in a low-temperature reactor and a nitrogen gas atmosphere, and 32.5 mg (0.09 mmol) of $NaBPh_4$ was added. Next, it was heated up to 0° C., 10° C., 20° C. for 1-hour reaction respectively. Finally, it was transferred to a shaking water bath at 30° C. to react for 24 hours. After the reaction was completed, the fabric was taken out and washed with deionized water and ethanol respectively, and dried at 50° C. to obtain the hydrophobic fabric with the water contact angles of 116.2° (BDA), 129.3° (CDA), 130.1° (DDA), 131.2° (MDA), 133.4° (ODA). The water contact angles of cotton fabrics carbene grafted with butyl diazoacetate and hexyl diazoacetate were 116.2° and 124.0°, respectively. However, the water contact angle of cotton fabrics carbene grafted with capryl diazoacetate increased rapidly to 129.3°. This was because the latter could also give the fiber surface a certain roughened structure during grafting modification, and the synergistic effect of chemical composition and physical structure on the modified fiber surface provided good hydrophobicity. Furthermore, when carbene grafting was performed on cotton fabric using dodecyl diazoacetate, myristyl diazoacetate, and octadexyl diazoacetate as monomers, it was found that the modified fabric did not significantly improve its water contact angle, indicating that low surface energy was not the only factor leading to changes in hydrophobic properties. The air permeability of the fabric grafted with butyl diazoacetate carbene polymerization was 137.5±1.7 $mm \cdot s^{-1}$, and the air permeability of the fabric grafted with capryl diazoacetate carbene polymerization was 112.2±2.4 $mm \cdot s^{-1}$. When the fabric was treated with dodexyl diazoacetate, myristyl diazoacetate, and octadexyl diazoacetate respectively, the air permeability decreased significantly to be 67.2±0.9 $mm \cdot s^{-1}$, 58.9±1.3 $mm \cdot s^{-1}$, and 66.4±2.8 $mm \cdot s^{-1}$, respectively.

Figure 5:
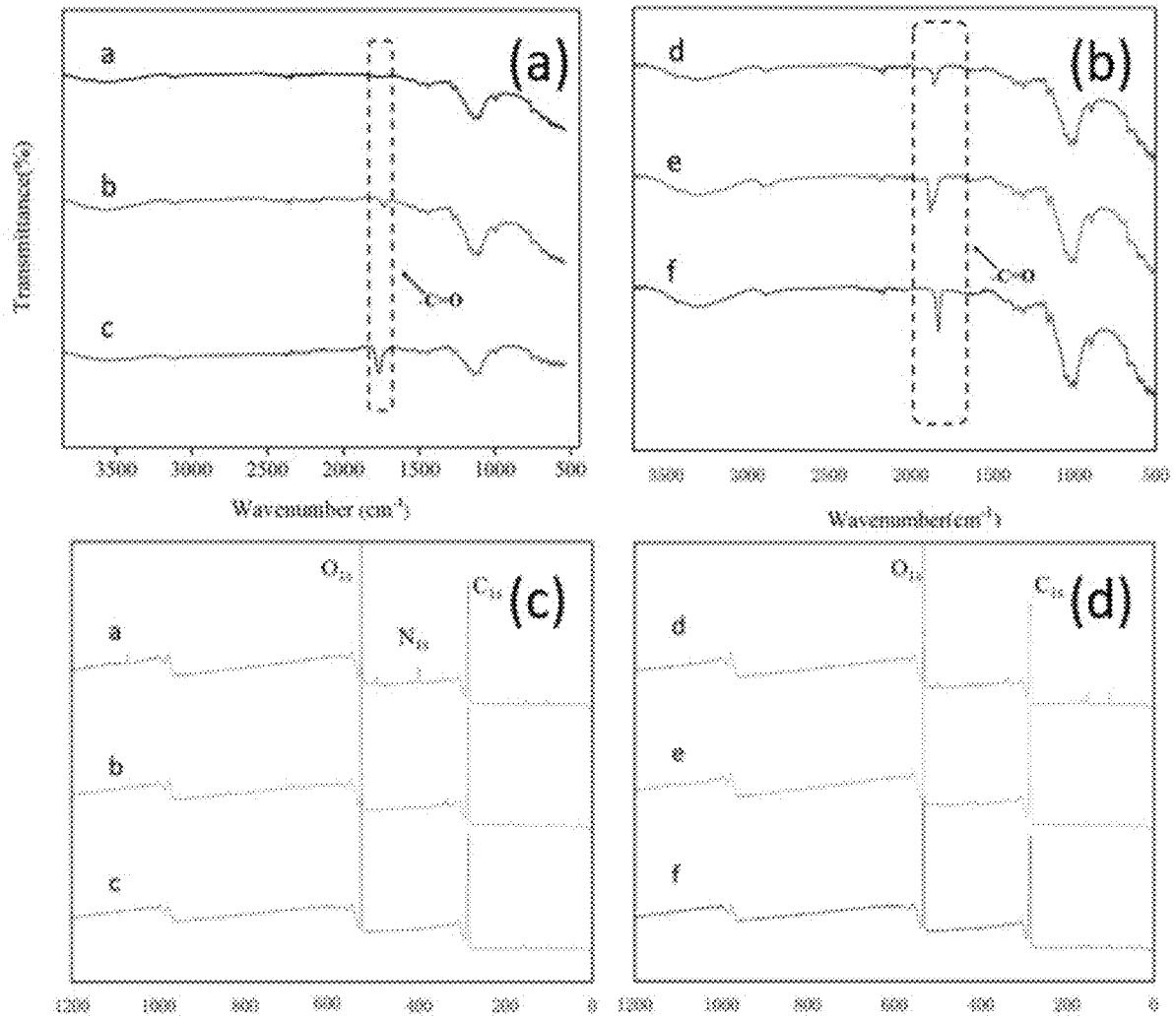
FIG. 5 shows the surface analysis of cotton fabrics before and after carbene grafting with different alkyl diazoacetates: a and b show the infrared total reflection spectra of the surface before and after grafting; c and b show the full spectrum of X-ray photoelectron spectroscopy of the surface before and after grafting.

The above-mentioned butyl diazoacetate (b), capryl diazoacetate (c), dodexyl diazoacetate (d), myristyl diazoacetate (e), and octadexyl diazoacetate (f) were used as monomers to perform carbene polymerization grafting modification on cotton fabric (a). The attenuated total reflection infrared (ATR) and X-ray photoelectron spectroscopy (XPS) spectra of the modified fibers were shown in FIG. 5.

Figure 6:
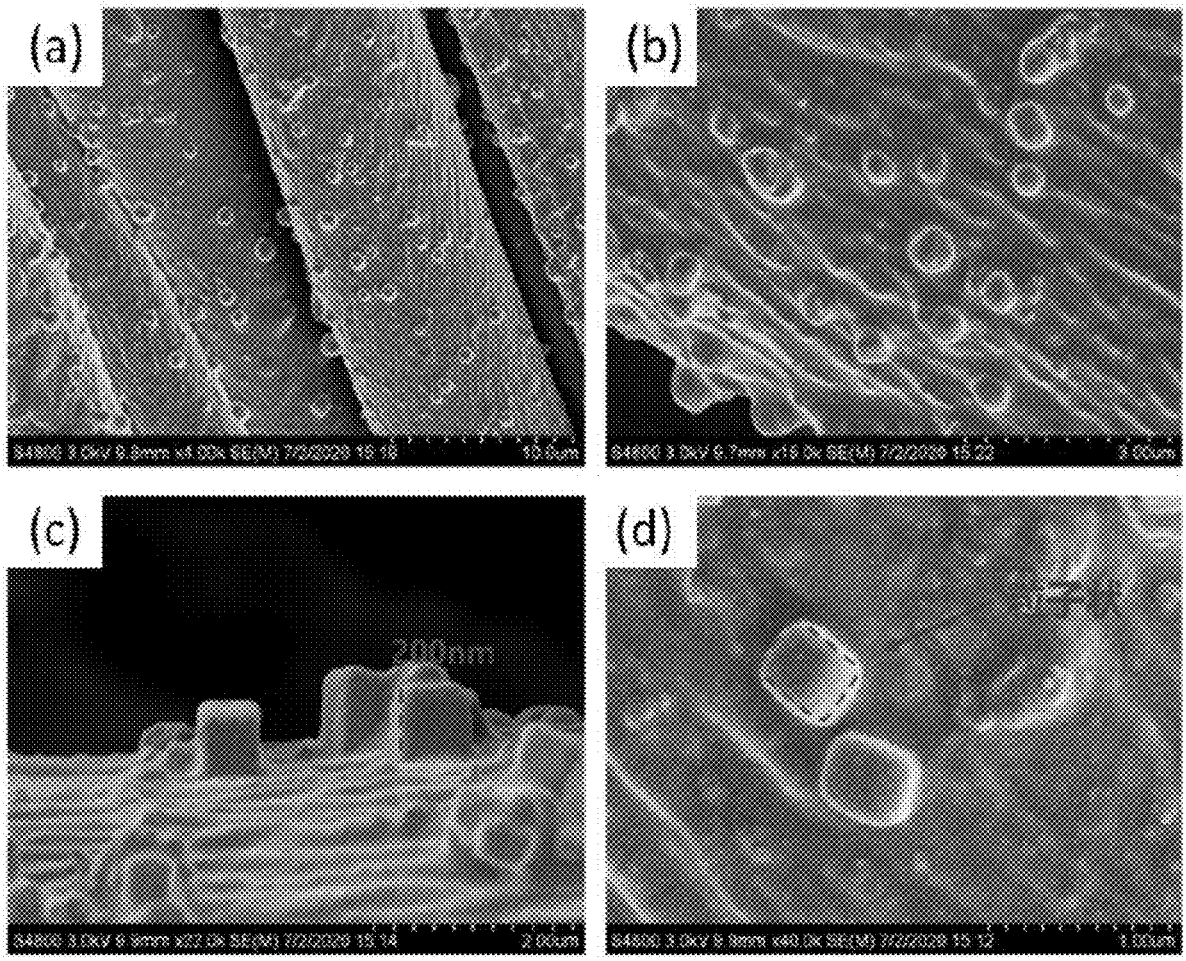
FIG. 6 shows the SEM image of the surface of P(BDA)—cotton: (a)×4000; (b)×15000; (c)×22000; (d)×40000.
Figure 7:
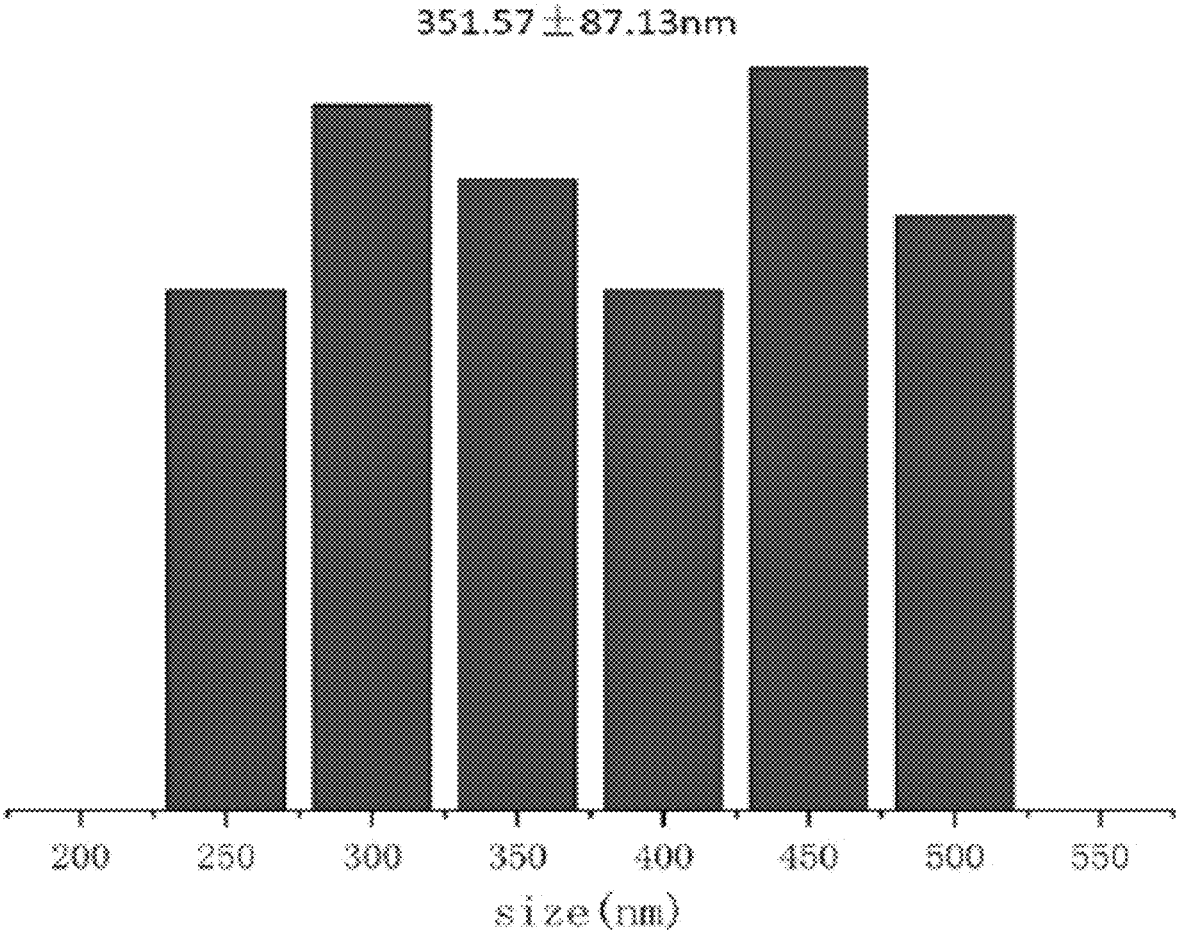
FIG. 7 shows the particle size distribution of the surface of P(BDA)—cotton.
Figure 8:
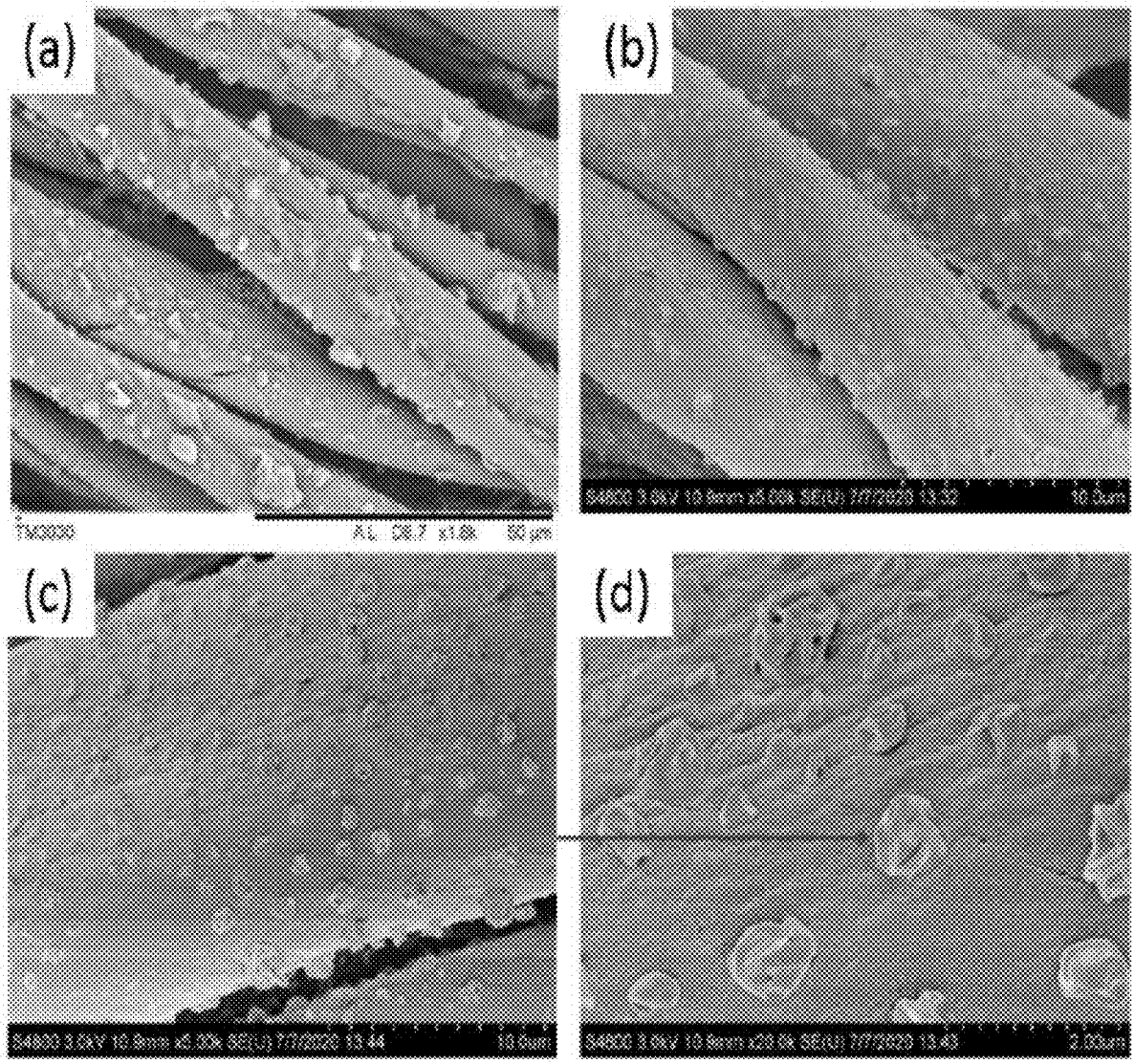
FIG. 8 shows the SEM image of the surface of P(CDA)—cotton: (a)×1800; (b)×5000; (c)×8000; (d)×20000.
Figure 9:
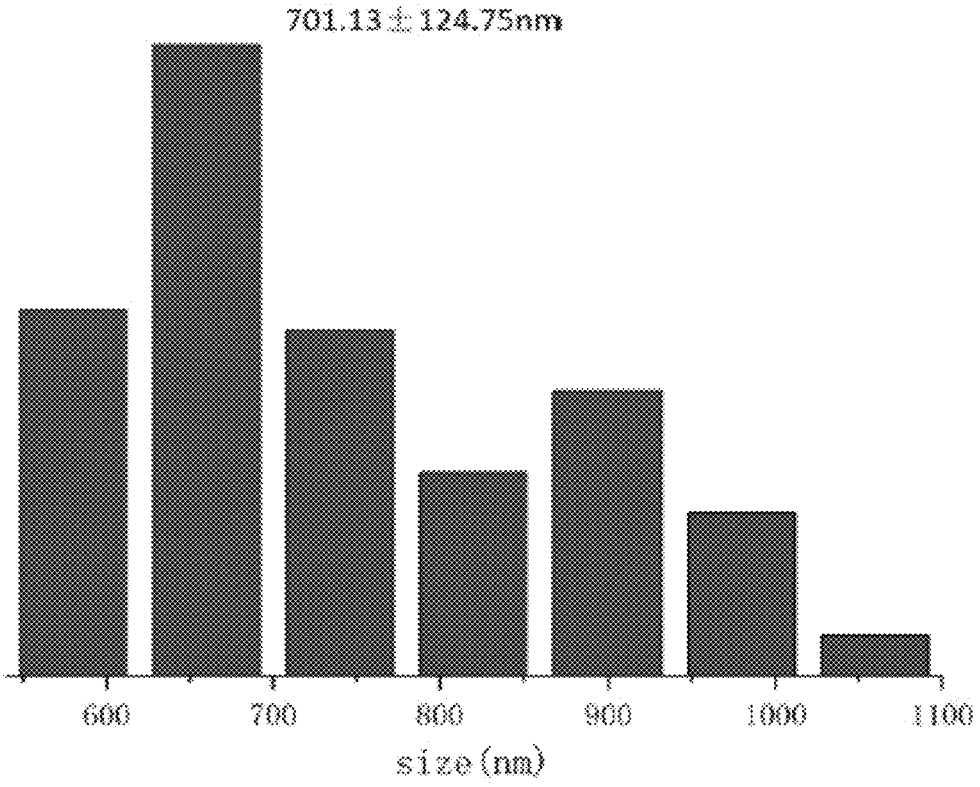
FIG. 9 shows the particle size distribution of the surface of P(CDA)—cotton.
Figure 10:
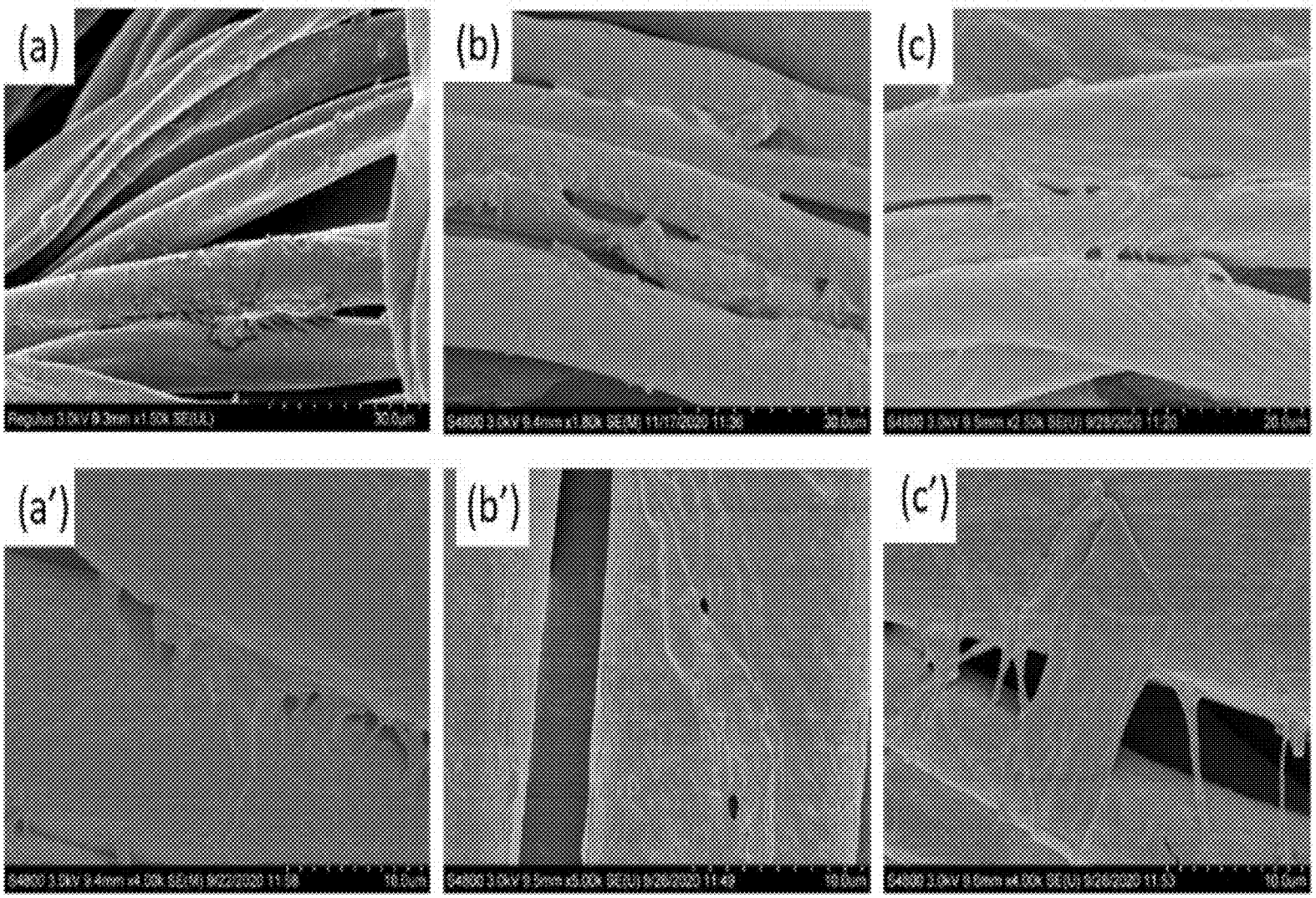
FIG. 10 shows the SEM image of the surface of P(DDA)—cotton (a×1500, a'×4000), P(MDA)—cotton (b×1500, b'×5000) and P(ODA)—cotton (c×2500, c'×4000).
Figure 11:
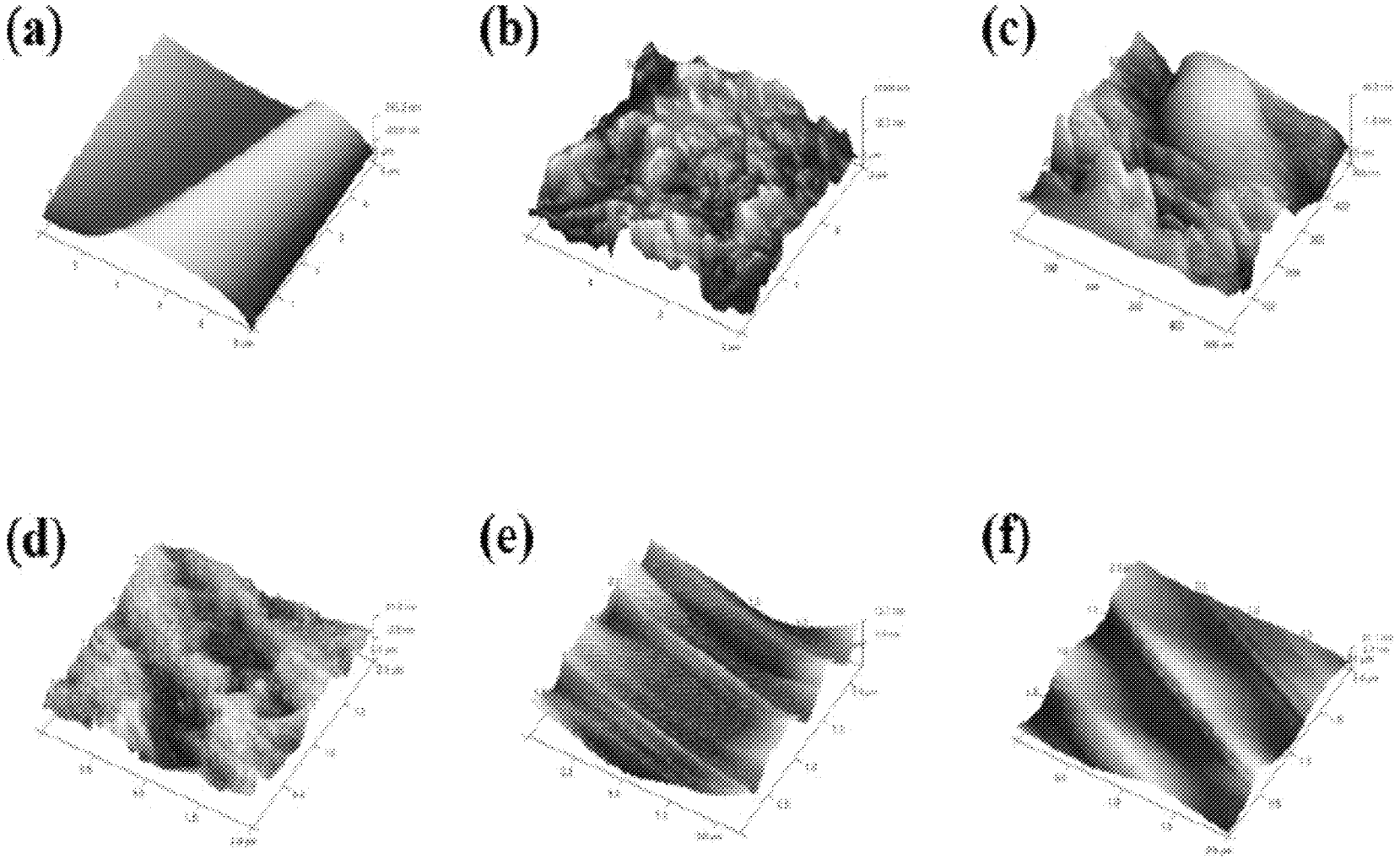
FIG. 11 shows the 3D image of the fabric surface tested by AFM: (a) cotton, (b) P(BDA)—cotton, (c) P(CDA)—cotton, (d) P(DDA)—cotton, (e) P(MDA)—cotton, (f) P(ODA)—cotton.

FIG. 6 showed the SEM image of the surface of cotton fabric modified by carbene polymerization with butyl diazoacetate. It can be seen that during carbene polymerization with butyl diazoacetate on the fiber surface, a particle-like bonding morphology was formed, and the size and distribution of the bonding particles on the surface were uniform. It was found through magnification that the particles had different shapes, most of which were irregular, and a small number of cubic particles also appeared. This was not commonly seen in the morphology of organic polymers. According to the statistics of particle size on the fiber surface (see FIG. 7), the average particle size was 351.57±87.13 nm. The SEM image of the fiber surface graft modified with capryl diazoacetate was shown in FIG. 8. It can be seen that a certain roughened structure could be formed when the capryl diazoacetate was used for graft modification. From (a) and (b), it can be seen that the fiber surface was uniformly dispersed with irregular protrusions, and the fibers were roughened. Figures (c) and (d) further showed that the surface of the roughened particles generated on the surface was irregular, with most particles collapsing and the surface regularity of the roughened particles decreasing. This also indicated the long substituent group chain on the extended carbene polymerization monomer. Although the low surface energy generated by the chemical structure was enhanced, the surface roughness and roughness regularity of the material gradually decreased. The size of irregular particles covered on the surface of fabric fibers was statistically analyzed, as shown in FIG. 9, and the average particle size was 701.13±124.75 nm. FIG. 10 showed the SEM images of the surfaces of cotton fibers carbene grafted with dodexyl diazoacetate. myristyl diazoacetate and octadexyl diazoacetate, respectively. It can be seen that after the grafting of diazo monomers, the polymer covering the surface of cotton fibers formed a film and did not exhibit roughened morphology. When the substituent group was a short alkyl group, the functional groups at the guiding side of the main chain of the polymers were dense, giving the main chain rigidity and resulting in higher stereoregularity of the polymer and easier formation of crystals on the surface of cotton fabrics, to finally result in a roughened morphology. On the contrary, when the length of the substituent carbon chain was too long, the soft and long carbon chains entangled with each other, hindering the growth of the carbene polymers. At the same time, the long carbon chain substituent group occupies most of the growth space, causing the generated carbene polymers to eventually form a film on the fiber surface. Further investigation was conducted through AFM to investigate the effect of diazoacetate monomers on the surface morphology of carbene graft modified cotton fibers. The 3D images and surface roughness RMS (nm) of cotton fabric fibers grafted with butyl diazoacetate, capryl diazoacetate, dodexyl diazoacetate, myristyl diazoacetate, and octadexyl diazoacetate were obtained. FIG. 11 (a) showed the 3D image of the surface of the raw cotton fiber, which showed that the fiber surface was relatively flat with an RMS roughness of only 9.42 nm; (b) showed the 3D image of the fiber surface after carbene grafting with butyl diazoacetate, and the roughened structure of the fiber surface could be clearly observed, and the RMS roughness also increased to 48.7 nm; Compared with that, the 3D image (c) of the fiber surface after carbene grafting with capryl diazoacetate showed a decrease in roughness, with an RMS value of 30.2 nm; (d) (e) and (f) were 3D images of the surface of cotton fibers modified by carbene grafting with dodexyl diazoacetate, myristyl diazoacetate, and octadexyl diazoacetate. It could be seen that the surface roughness of the modified fibers by carbene grafting gradually decreased until they approached a smooth morphology, and the RMS values also decreased to 18.2 nm, 15.4 nm, and 12.1 nm, respectively. The 2D, 3D, and sectional level map of the surface morphology of fabric after 24 hours of reaction with hexyl diazoacetate/fiber surface hydroxyl group at the molar ratio of 30:1 measured, and the interfacial level (RMS, nm) of the fabric was 61.22 nm. It was tested by AFM through the scanning within the range of 2 μm, the complete three-dimensional morphology of micron-sized cluster particles was obtained, and the highest interfacial level was measured to be 100 nm. As can be seen from the above, the optimal process was the reaction of diazoacetate/fiber surface hydroxyl group at 30:1 (mol/mol) at 30° C. for 24 hours. The comprehensive properties of the treated fabric, such as thermal stability, air permeability, and breaking strength, were tested. The heat resistance and breaking strength of the treated fabric slightly decreased, and the air permeability was good. The present invention overcame the problem of using materials containing fluorine for hydrophobic finishing in existing technology. By using fluorine-free materials, it achieved a good effect of 130° water contact angle and maintained good air permeability.

The invention claimed is:

1. A fluorine-free carbon chain hydrophobic fabric, wherein a diazotized fabric reacts with a diazoacetate monomer to obtain the fluorine-free carbon chain hydrophobic fabric; and the diazoacetate monomer is butyl diazoacetate, hexyl diazoacetate, capryl diazoacetate, dodexyl diazoacetate, myristyl diazoacetate, or octadexyl diazoacetate.

2. The fluorine-free carbon chain hydrophobic fabric according to claim 1, wherein a fabric is sequentially soaked in an alkaline solution and an acid solution to obtain a pre-treated fabric; then, the pre-treated fabric is reacted with bromoacetyl bromide to obtain a treated fabric; the treated fabric is reacted with 1,2-bis (p-Toluenesulfonyl) hydrazine to obtain the diazotized fabric.

3. The fluorine-free carbon chain hydrophobic fabric according to claim 2, wherein the alkaline solution is sodium hydroxide aqueous solution.

4. The fluorine-free carbon chain hydrophobic fabric according to claim 2, wherein the acid solution is glacial acetic acid aqueous solution; when the pre-treated fabric is reacted with bromoacetyl bromide, sodium bicarbonate is used as an acid binding agent, and the reaction is carried out at −5° C. to 25° C. for 1-24 hours; the reaction between the pre-treated fabric and 1,2-bis (p-Toluenesulfonyl) hydrazine is carried out in the presence of DBU, and the reaction is carried out at 0-25° C. for 1-24 hours.

5. The fluorine-free carbon chain hydrophobic fabric according to claim 1, wherein the fabric is a natural fiber fabric, a chemical fiber fabric, or a blend thereof.

6. The preparation method of the fluorine-free carbon chain hydrophobic fabric according to claim 1, wherein the diazotized fabric reacts with diazoacetate monomer to obtain the fluorine-free carbon chain hydrophobic fabric.

7. The preparation method of the fluorine-free carbon chain hydrophobic fabric according to claim 6, wherein a molar ratio of diazoacetate monomer to diazotized cotton fabric surface hydroxyl is 5-40:1.

8. The preparation method of the fluorine-free carbon chain hydrophobic fabric according to claim 6, wherein the reaction of diazotized fabric and diazoacetate monomer is carried out under nitrogen gas, in a solvent, in the presence of palladium catalyst and reducing agent.

9. An application of a diazoacetate monomer in the preparation of fluorine-free carbon chain hydrophobic fabric; wherein the diazoacetate monomer is butyl diazoacetate, hexyl diazoacetate, capryl diazoacetate, dodexyl diazoacetate, myristyl diazoacetate, or octadexyl diazoacetate.

10. An application of the fluorine-free carbon chain hydrophobic fabrics according to claim 1 in the preparation of hydrophobic flexible materials.

* * * * *